US007954262B2

(12) United States Patent
Bernier

(10) Patent No.: US 7,954,262 B2
(45) Date of Patent: Jun. 7, 2011

(54) ADAPTER FRAME AND METHOD FOR INSTALLING THE SAME

(75) Inventor: Jeff Bernier, Granby (CA)

(73) Assignee: 177197 Canada Limitée, St-Valerien-de-Milton (CA)

( * ) Notice: Subject to any disclaimer, the term of this patent is extended or adjusted under 35 U.S.C. 154(b) by 0 days.

(21) Appl. No.: 11/935,776

(22) Filed: Nov. 6, 2007

(65) Prior Publication Data

US 2008/0271349 A1 Nov. 6, 2008

(30) Foreign Application Priority Data

May 3, 2007 (CA) ..... 2587290

(51) Int. Cl.
*E01H 5/04* (2006.01)

(52) U.S. Cl. ..... 37/231; 37/281; 37/403; 37/468; 172/272; 172/810

(58) Field of Classification Search ..... 37/281, 37/231, 403, 468, 407, 442; 172/272, 810, 172/811, 817; 414/686, 723
See application file for complete search history.

(56) References Cited

U.S. PATENT DOCUMENTS 3,279,104 A * 10/1966 Wandscheer et al. ..... 37/280
3,410,008 A 11/1968 Standfuss
3,876,092 A * 4/1975 MacDonald ..... 414/686
3,987,562 A 10/1976 Deen et al.
4,208,162 A * 6/1980 Neitzel ..... 414/686
4,236,329 A * 12/1980 Hetrick ..... 37/231
4,249,323 A 2/1981 Mathis et al.
4,565,018 A 1/1986 Oya
4,625,988 A * 12/1986 Witchey et al. ..... 280/461.1
4,744,159 A * 5/1988 Houle ..... 37/231
5,082,065 A 1/1992 Fletcher
5,098,252 A * 3/1992 Sheesley et al. ..... 414/723
5,107,610 A * 4/1992 Fusco ..... 37/444
5,148,617 A * 9/1992 Feller et al. ..... 37/281
5,224,816 A * 7/1993 Kaczmarczyk et al. ..... 414/723
5,394,630 A * 3/1995 Moinat ..... 37/468
5,597,283 A * 1/1997 Jones ..... 414/723
5,685,689 A * 11/1997 Schneider et al. ..... 414/723
5,706,591 A * 1/1998 Wissmiller ..... 37/231
5,743,339 A * 4/1998 Alexander, III ..... 172/272
5,819,444 A * 10/1998 Desmarais ..... 37/281
5,865,594 A * 2/1999 Kim ..... 414/723
5,870,839 A 2/1999 Wissmiller
6,170,178 B1 1/2001 Christy
6,354,024 B1 * 3/2002 Kost et al. ..... 37/231
6,412,200 B1 * 7/2002 Savard ..... 37/281
6,499,934 B1 * 12/2002 Kaczmarski et al. ..... 414/723

(Continued)

*Primary Examiner* — Thomas A Beach
*Assistant Examiner* — Matthew R Buck
(74) *Attorney, Agent, or Firm* — Baker & Hostetler LLP

(57) ABSTRACT

An adapter frame for installation of a front and an accessory implement, such as a snowplow blade and a sidewing, on a vehicle having a coupling plate is disclosed. The adapter frame has a frame structure. The adapter frame also comprises a hitch coupling mechanism for removably coupling the adapter frame to the vehicle coupling plate. The adapter frame further comprises a front implement coupling receptacle mechanism for removably receiving a corresponding coupling mechanism arranged on a front implement support frame attached to a rear portion of the front implement, the front implement support frame coupling mechanism being adapted to be removably coupled to the vehicle coupling plate. The adapter frame also comprises an accessory implement coupling mechanism for removably coupling the adapter frame to the accessory implement. The adapter frame increases the implement reconfiguration capability of the vehicle. A method for installing the adapter frame is also disclosed.

16 Claims, 7 Drawing Sheets

U.S. PATENT DOCUMENTS

| | | | | |
|---|---|---|---|---|
| 6,533,528 | B2 * | 3/2003 | Degen et al. | 414/723 |
| 6,581,307 | B1 * | 6/2003 | Jones et al. | 37/281 |
| 6,594,923 | B1 | 7/2003 | Kost et al. | |
| 6,619,906 | B2 * | 9/2003 | Dick | 414/723 |
| 6,866,467 | B2 * | 3/2005 | Dvorak et al. | 414/723 |
| 6,877,258 | B2 | 4/2005 | Frey | |
| 6,988,560 | B2 | 1/2006 | Bay | |
| 7,114,270 | B2 * | 10/2006 | Potak | 37/231 |
| 7,146,754 | B2 | 12/2006 | Schultz et al. | |
| 7,182,546 | B1 * | 2/2007 | Kimble | 403/322.3 |
| 7,225,566 | B1 * | 6/2007 | Kimble | 37/468 |
| 7,337,564 | B2 * | 3/2008 | Kimble | 37/468 |
| 7,353,628 | B2 * | 4/2008 | Potak | 37/231 |
| 7,540,103 | B2 * | 6/2009 | Broten | 37/276 |
| 7,648,326 | B2 * | 1/2010 | Santele et al. | 414/723 |
| 2003/0221338 | A1 | 12/2003 | Verseef | |
| 2004/0025380 | A1 | 2/2004 | Frey | |
| 2004/0144001 | A1 * | 7/2004 | Potak | 37/231 |
| 2005/0166428 | A1 * | 8/2005 | Hollinrake et al. | 37/231 |

* cited by examiner

ADAPTER FRAME AND METHOD FOR INSTALLING THE SAME

CROSS-REFERENCE TO RELATED APPLICATIONS

This application claims priority of Canada Patent Application 2,587,290 filed May 3, 2007, the entire disclosure of which is incorporated herein by reference.

FIELD OF THE INVENTION

The present invention generally relates to vehicles used residential or commercial contexts, or the like. More particularly, it relates to an adapter frame to be added to the front end of a vehicle for attachment of a front implement and an accessory implement, as well as a method for installing the adapter frame on the vehicle.

BACKGROUND OF THE INVENTION

Snowplows are commonplace in areas which require removal of snow from roads, parking lots and other locations. The snowplow is usually fitted on the front end of a vehicle and generally comprises a principal snowplow blade as well as sidewing for certain applications.

There exist several types of mechanisms for installation of the blade and the sidewing on the front of the vehicle. In order to facilitate mounting of the blades, several parallelogram lift system plows allow installation of the blade on the vehicle through a standard coupling plate installed on the front of the vehicle comprising a number of coupling receptacles. The coupling receptacles are adapted to receive corresponding coupling mechanisms arranged on a standard blade support plate attached to the rear of the blade. The configurations of the blades themselves may vary but they are all usually attached to different standard blade support plates.

Mounting of the blade on the truck is accomplished through installation of the blade support plate on a corresponding vehicle coupling plate.

North-American snowplows often require the use of a sidewing in addition to the front blade in situations where the blade offers poor snow removal efficiencies and capacity due to the limited width of the blade. Unfortunately, in order to use sidewings on vehicles having the European-type coupling plate, the sidewing structure typically has to be installed directly on the vehicle or any coupling structure fixed on the vehicle. This configuration imposes limits on the number of blade-sidewing configurations that can easily be used with a same vehicle.

In situations where the sidewing has been installed on the vehicle with a European-type coupling plate, it is possible to easily have a blade-sidewing combination for certain uses as the blade is installed on the coupling plate. However, if a use of the vehicle does not require the front blade, the front blade may be removed quickly though the coupling plate, but the sidewing and its associated sidewing support structure remain attached to the vehicle and cannot be removed as quickly.

Similarly, if certain applications only require the use of the plow blade and not the sidewing, the current vehicle configuration does not allow rapid removal of the sidewing as it is fixed to the vehicle and can only be unmounted through a more complicated procedure that requires significant downtime for the vehicle. In certain cases, even if the sidewing is removed temporarily, a sidewing support structure must be left on the vehicle to facilitate eventual reinstallation of the sidewing, which leaves the truck with a certain amount of dead weight associated with the sidewing support structure.

Unfortunately, there is presently no system which allows rapid installation and removal of snowplow blades and sidewings on the front of a vehicle, with the flexibility of being able to reconfigure the vehicle rapidly between a number of configurations. These configurations include having the vehicle without the blade and sidewing, having the vehicle with the blade and sidewing, and having the vehicle with the front blade only or the sidewing only.

Thus, there is still presently a need for a system which allows rapid installation and removal of different implements, such as snowplow blades and sidewings, on the front of vehicle, with the flexibility of being able to reconfigure the above-mentioned configurations. Furthermore there is also a need for a system that can generate weight savings during use of the plow with the blade only, or the sidewing only, when required, while also having the option of using the plow with a combination of the two.

SUMMARY OF THE INVENTION

An object of the present invention is to propose an adapter frame that satisfies the above-mentioned need.

According to the present invention, that object is achieved with an adapter frame that can be attached to existing vehicle coupling plates.

According to the present invention, there is provided an adapter frame for installation of a front implement and an accessory implement on a vehicle having a coupling plate, the adapter frame comprising a frame structure, a hitch coupling mechanism attached to the frame structure for removably coupling the adapter frame to the vehicle coupling plate, a front implement coupling receptacle mechanism attached to the frame structure and receiving a corresponding coupling mechanism arranged on a front implement support frame attached to a rear portion of the front implement, the front implement support frame coupling mechanism being adapted to be removably coupled to the vehicle coupling plate, and an accessory implement coupling mechanism attached to the frame structure for removably coupling the adapter frame to the accessory implement.

More particularly, the present invention provides a system which allows rapid mounting and unmounting of implements, such as a snowplow blade and a sidewing on vehicles having a standard European-type coupling plate on the front of the vehicle.

The present invention also provides a method for removably installing a front implement and an accessory implement on a vehicle, the method comprising the steps of providing a coupling plate on the vehicle and an adapter frame comprising a frame structure, a hitch coupling mechanism attached to the frame structure for removably coupling the adapter frame to the vehicle coupling plate, a front implement coupling receptacle mechanism attached to the frame structure and receiving a corresponding coupling mechanism arranged on a front implement support frame attached to a rear portion of the front implement, the front implement support frame coupling mechanism being adapted to be removably coupled to the vehicle coupling plate, and an accessory implement coupling mechanism attached to the frame structure for removably coupling the adapter frame to the accessory implement coupling the adapter frame to the accessory implement, coupling the adapter frame with the vehicle coupling plate, and coupling the front implement support frame with the adapter frame.

According to the present invention, there is also provided an adapter frame for installation of a front implement on a vehicle having a coupling plate, the adapter frame comprising a frame structure, a hitch coupling mechanism attached to the frame structure for removably coupling the adapter frame to the vehicle coupling plate, a front implement coupling receptacle mechanism attached to the frame structure and receiving a corresponding coupling mechanism arranged on a front implement support frame attached to a rear portion of the front implement, said front implement support frame coupling mechanism being adapted to be removably coupled to the vehicle coupling plate, and an accessory implement attached to the frame structure.

A non-restrictive description of a preferred embodiment of the invention will now be given with reference to the appended drawings.

DESCRIPTION OF PREFERRED EMBODIMENTS

Figure 1:
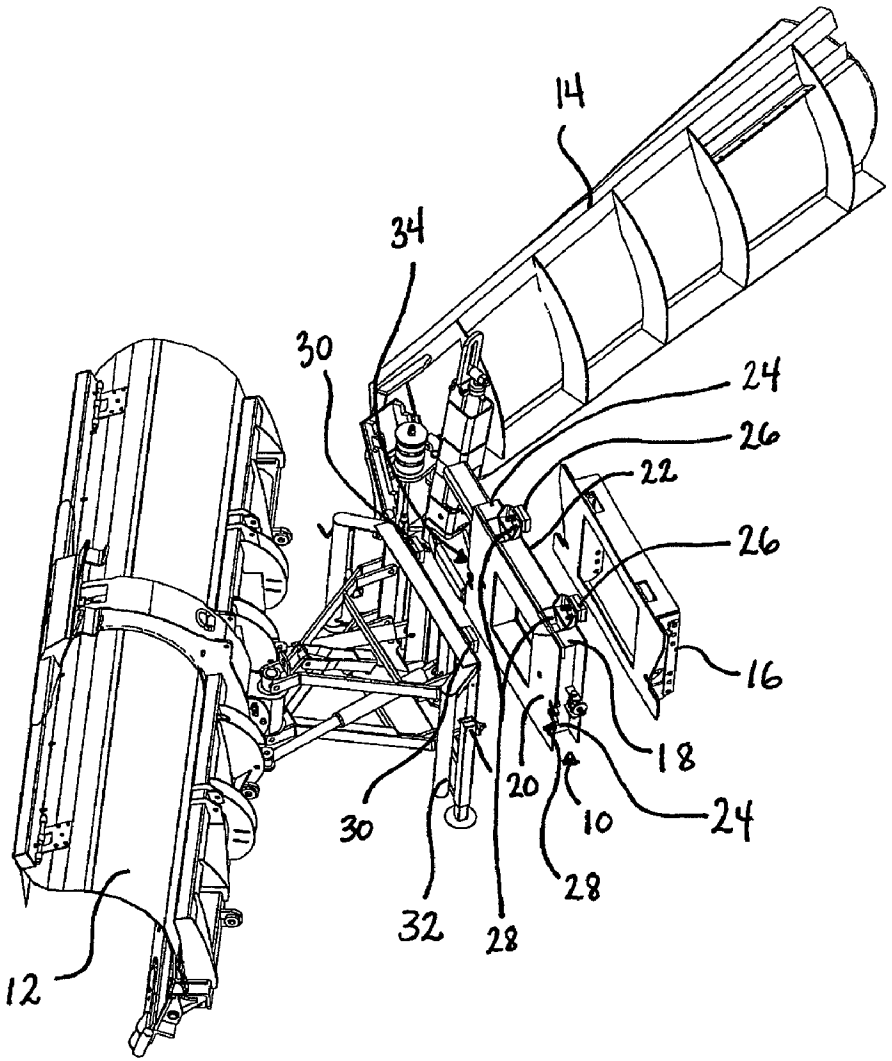
FIG. 1 is a perspective view of an adapter frame according to a preferred embodiment of the present invention, shown in relation with a vehicle coupling plate, a snowplow blade and a sidewing.
Figure 2:
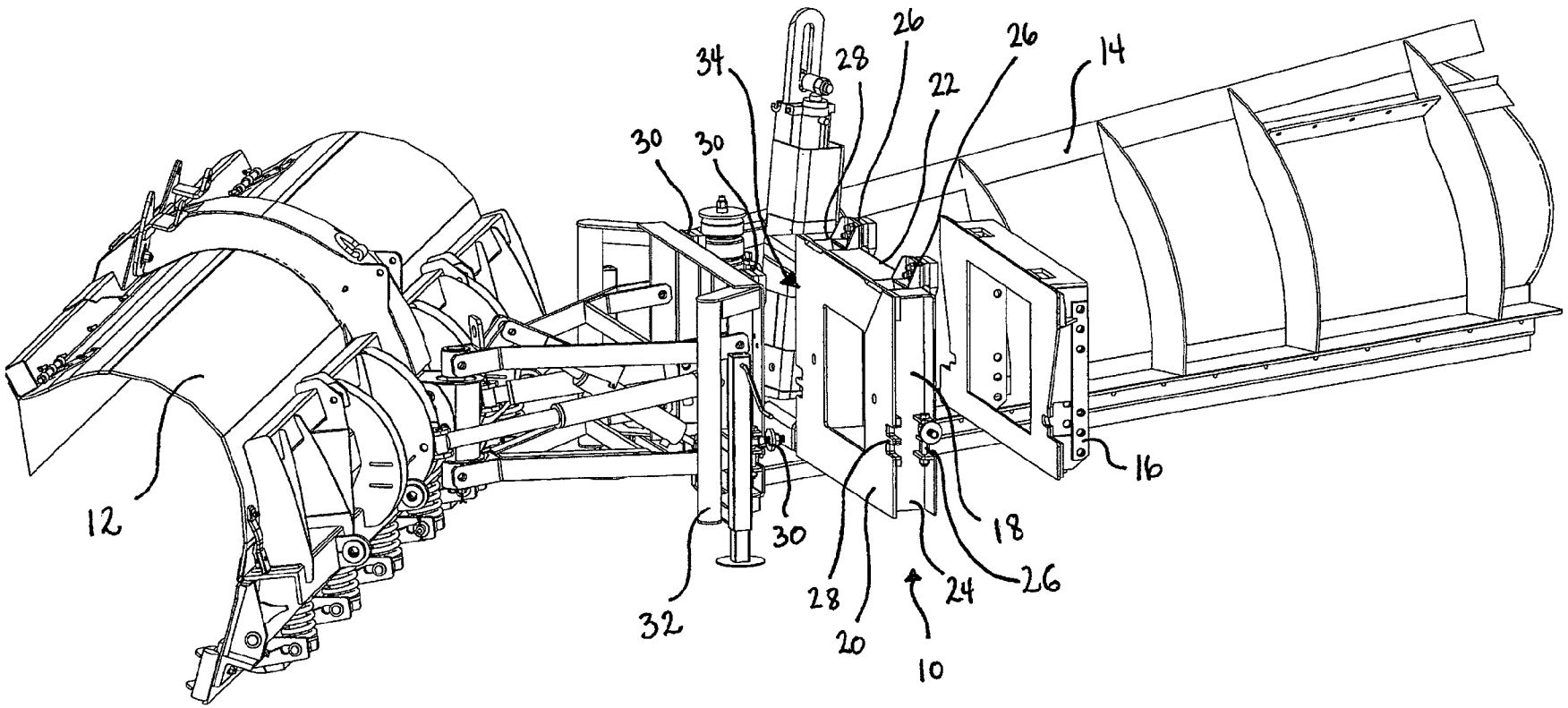
FIG. 2 is another perspective view of the adapter plate shown in FIG. 1.

Referring to FIGS. 1 to 7, the present invention provides an adapter frame 10 for installation of a front implement 12 and an accessory implement 14, such as a snowplow blade and a sidewing, on a vehicle having a coupling plate 16. The adapter frame 10 comprises a frame structure 18 comprising a front surface 20, a rear surface 22 and two side surfaces 24. The adapter frame 10 also comprises a hitch coupling mechanism 26 for removably coupling the adapter frame 10 to the vehicle coupling plate 16. The adapter frame 10 further comprises a front implement coupling receptacle mechanism 28 for removably receiving a corresponding coupling mechanism 30 arranged on a front implement support frame 32 attached to a rear portion of the front implement 12. The front implement support frame 32 coupling mechanism 30 is adapted to be removably coupled to the vehicle coupling plate 16. The adapter frame 10 further comprises an accessory implement coupling mechanism 34 attached to the adapter frame, preferably on at least one of the side surfaces 24, for removably coupling the adapter frame 10 to the accessory implement 14. In the embodiment shown in the figures with a sidewing, the sidewing may be placed on either side of the adapter frame or on both sides if required. Different types of coupling mechanism, coupling receptacle mechanisms can be used and are not restricted to the ones shown in the figures.

As explained previously, the front and accessory implements are preferably snowplow blades and sidewings. The system illustrated in the figures allows rapid installation and removal of snowplow blades 12 and sidewings 14 on the front of a vehicle. The vehicle can be reconfigured rapidly between a number of configurations. These configurations include having the vehicle without the blade and sidewing, having the vehicle with the blade and sidewing, and having the vehicle with the front blade only or the sidewing only. However, the present invention is not limited to the use of snowplow blades and sidewings. The front and accessory implements may be any type of implement that is typically attached to a vehicle, including, but not limited to, brush systems, water pouring or cleaning jet systems, liquid reservoirs or any other type of implement carried by a vehicle.

Figure 3:
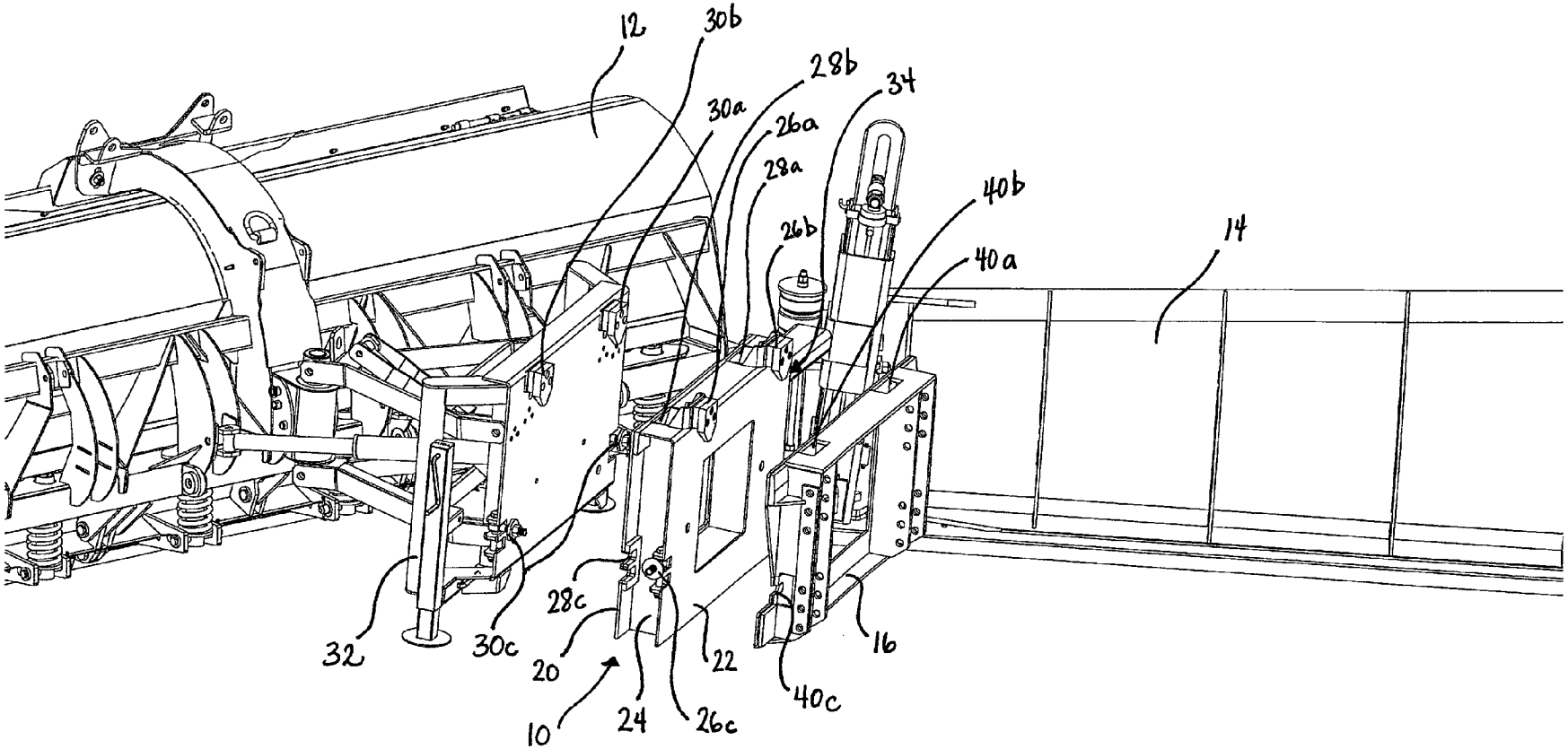
FIG. 3 is another perspective view of the adapter plate shown in FIG. 1.
Figure 4:
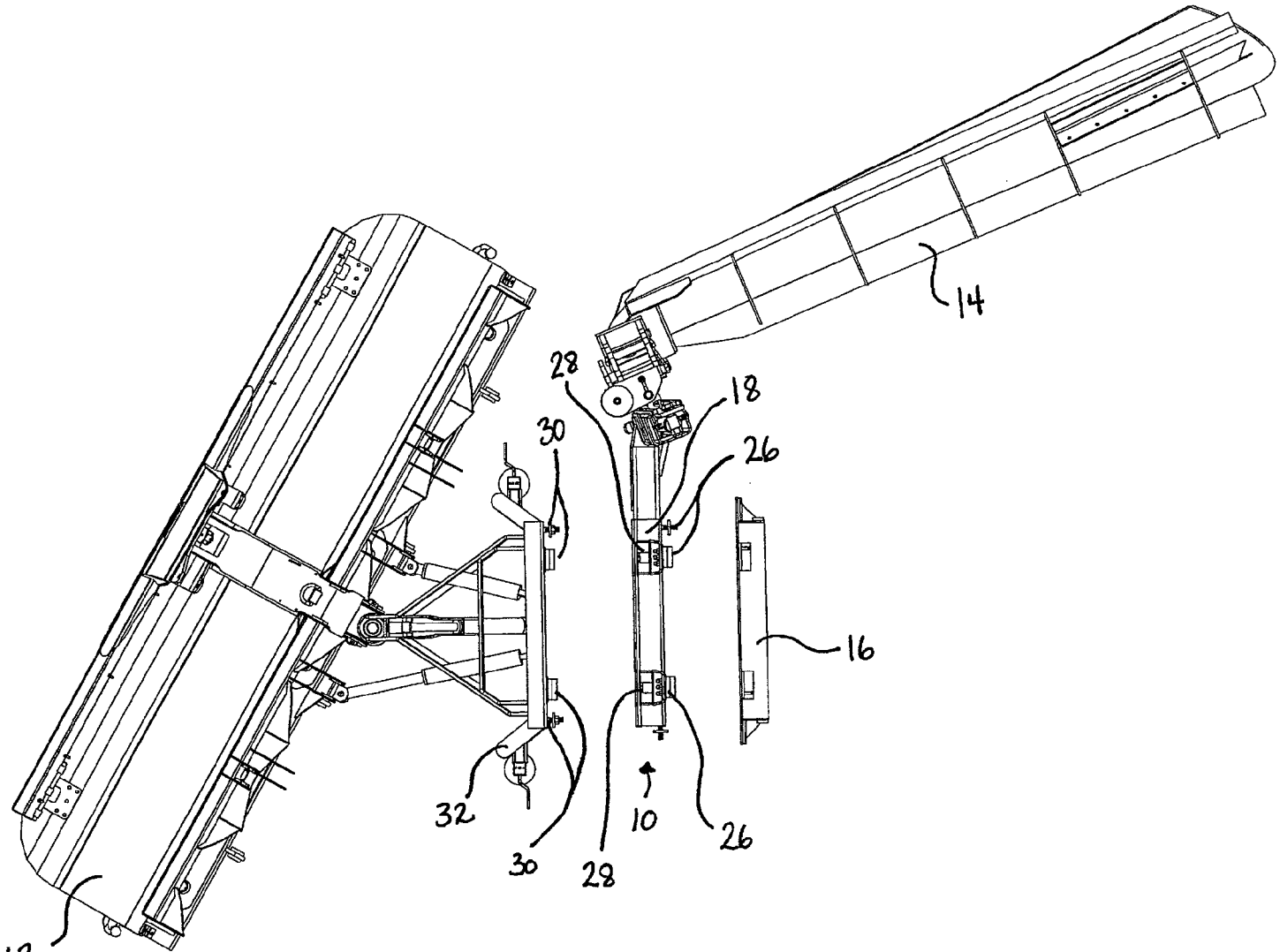
FIG. 4 is a top view of the adapter plate shown in FIG. 1.
Figure 5:
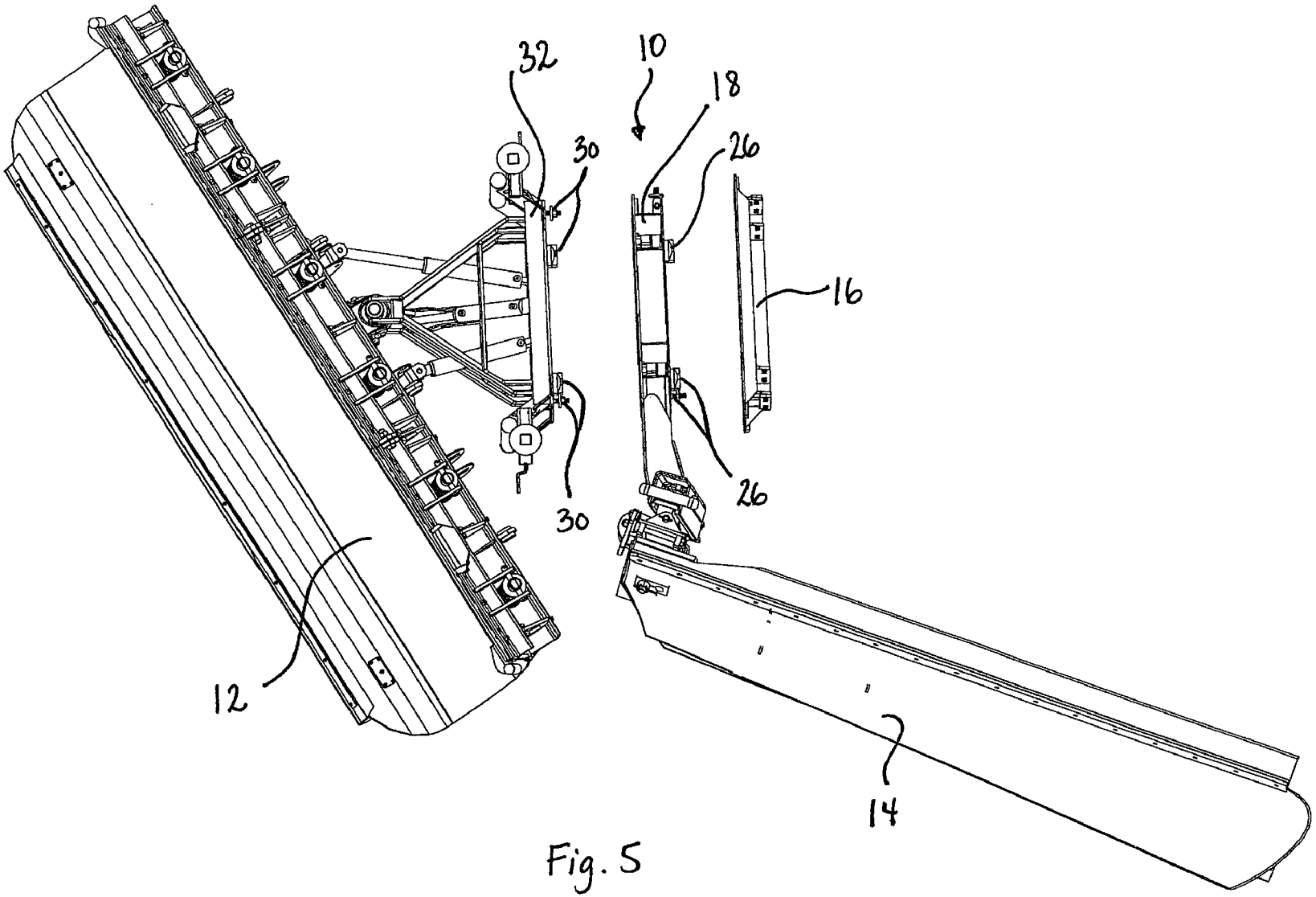
FIG. 5 is a bottom view of the adapter plate shown in FIG. 1.
Figure 6:
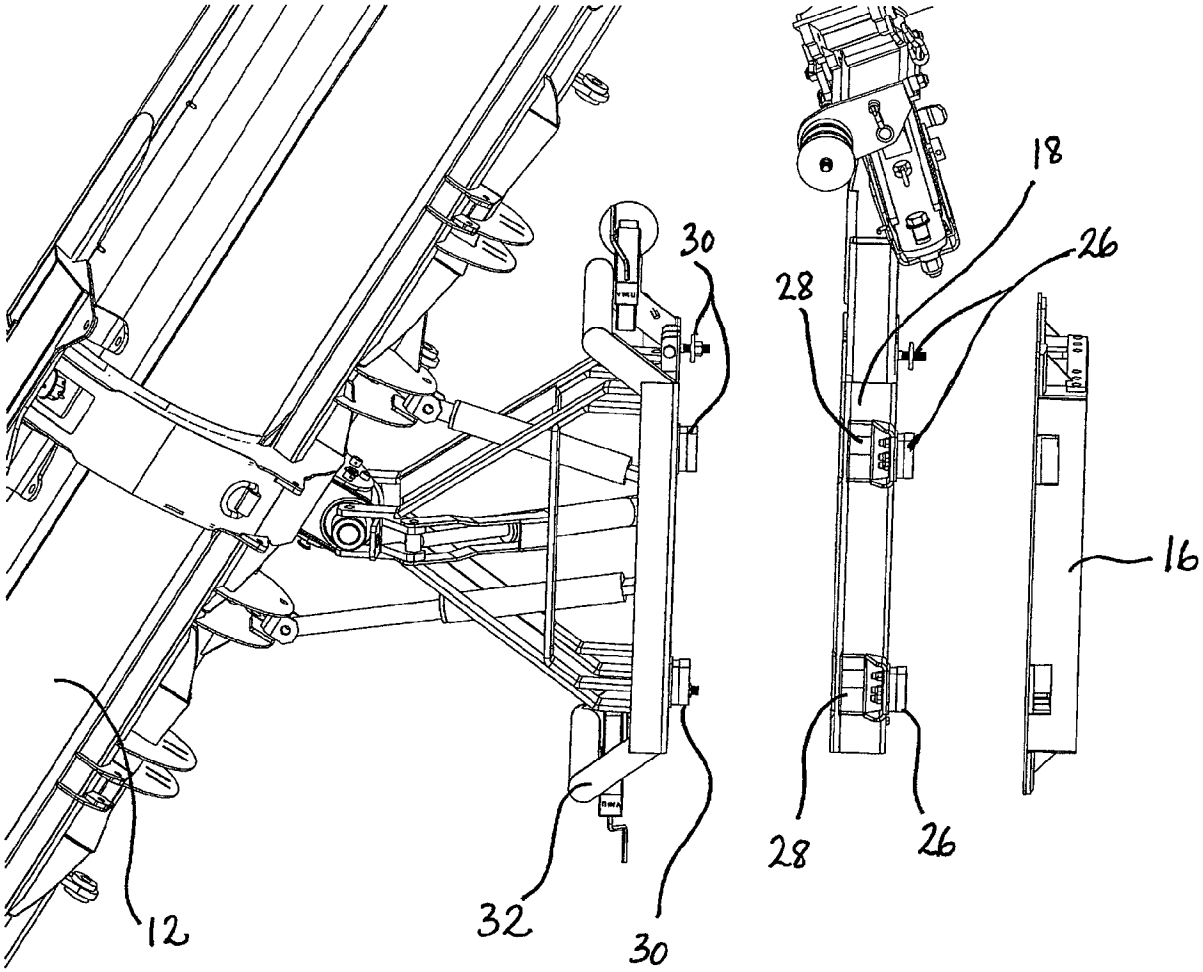
FIG. 6 is a zoomed-in top view of the adapter plate shown in FIG. 4.
Figure 7:
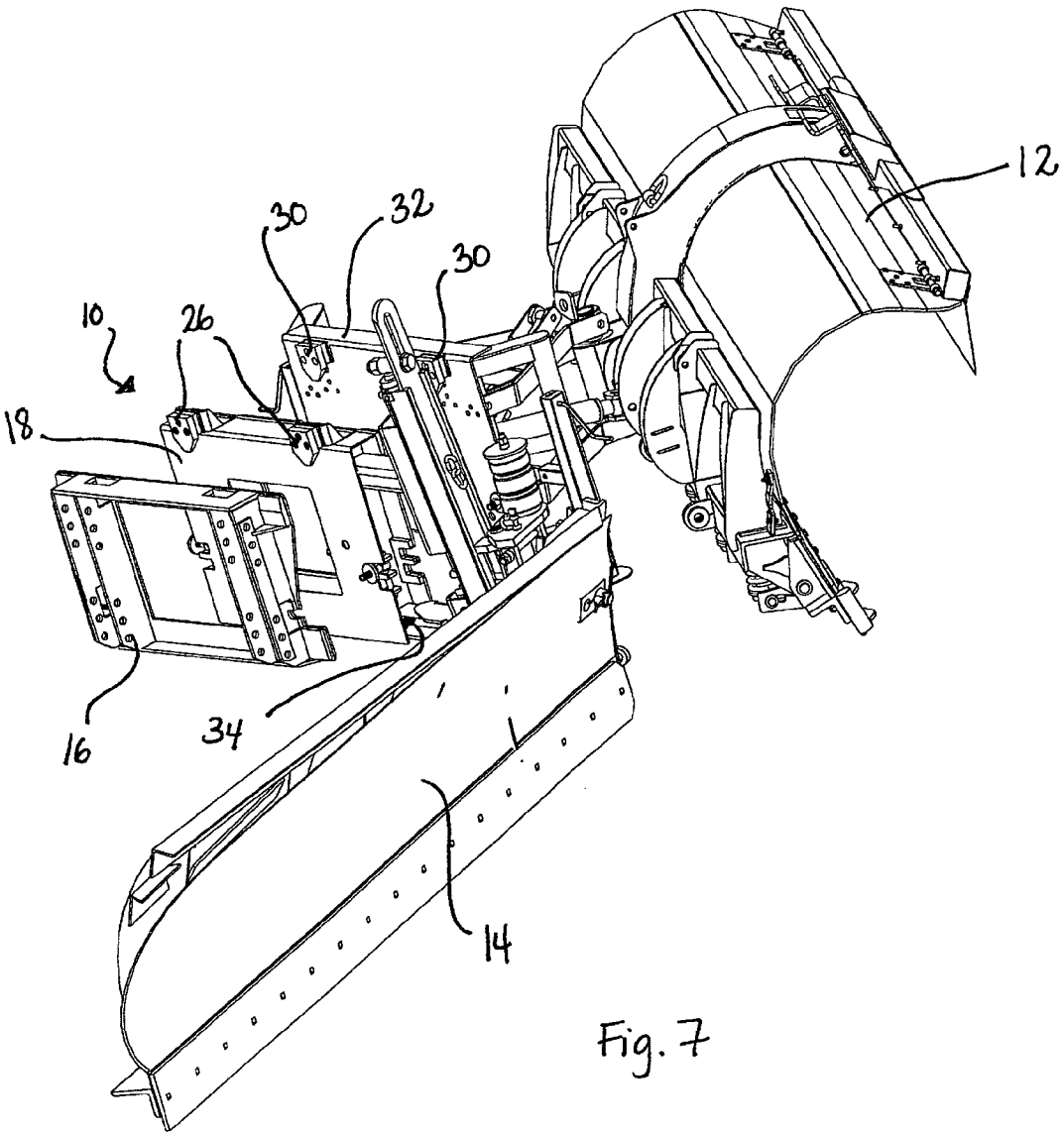
FIG. 7 is another perspective view of the adapter plate shown in FIG. 1.

Preferably, as shown in FIG. 3, the hitch coupling mechanism 26 comprises a pair of wedging engagement members 26*a*, 26*b* shaped to be inserted into corresponding receptacle structures 40*a*, 40*b* on the vehicle coupling plate 16.

Preferably, the hitch coupling mechanism 26 further comprises a locking system 26*c*, to engage and lock the adapter frame 10 to a corresponding locking system receiving structure 40*c* on the coupling plate.

Preferably, the locking system 26*c* is a bolt system.

Preferably, the front implement coupling receptacle mechanism 28 comprises a pair of adapter receptacle structures 28*a* and 28*b* that are shaped to receive corresponding wedging engagement members 30*a*, 30*b* on the front implement support structure 32.

Preferably, the front implement coupling receptacle mechanism 28 further comprises a locking system receiving structure 28*c* shaped to receive a corresponding front implement locking system 30*c* on the front implement support structure 32.

According to another embodiment of the present invention, the accessory implement, such as a sidewing, may be permanently attached to the adapter frame structure.

In the illustrated application of the invention to a snowplow blade with a sidewing as shown in the figures, the hitch coupling mechanism 26 comprises a pair of wedging engagement members 26*a*, 26*b* that can be inserted into corresponding receptacles 40*a*, 40*b* on the vehicle coupling plate 16. The hitch coupling mechanism 26 also comprises a bolt system 26*c* that can engage and lock the adapter frame 10 through a corresponding bolt receiving structure 40*c* on the coupling plate. It should be noted that the pair of wedging engagement members 26*a*, 26*b* are similar to engagement members 30*a*, 30*b* on the blade support structure 32. Similarly, the blade coupling receptacle mechanism 28 comprises a pair of receptacles 28*a* and 28*b* and a bolt receiving structure 28*c* that are adapted to receive the corresponding engagement members 30*a*, 30*b* and bolt system 30*c* on the blade support structure 32. These similarities in the two interfaces, i.e. (1) between the adapter frame and the vehicle coupling plate and (2) between the blade support structure and the adapter frame, allow the blade support structure to either be installed directly on the vehicle coupling plate, or be installed on the adapter frame and the adapter frame is, in turn, installed on the vehicle coupling plate. As mentioned above, the present invention is not restricted to the specific mechanism shown in FIG. 3 and other types of coupling mechanisms between the adapter frame, the vehicle coupling plate and the blade support structure may be used, as different plows may use different standard coupling plates.

The present invention also provides a method for removably installing a front implement and an accessory implement on a vehicle, the method comprising the steps of providing a coupling plate on the vehicle and an adapter frame comprising a frame structure, a hitch coupling mechanism attached to the frame structure for removably coupling the adapter frame to the vehicle coupling plate, a front implement coupling receptacle mechanism attached to the frame structure and receiving a corresponding coupling mechanism arranged on a front implement support frame attached to a rear portion of the front implement, said front implement support frame coupling mechanism being adapted to be removably coupled to the vehicle coupling plate, and an accessory implement coupling mechanism attached to the frame structure for removably coupling the adapter frame to the accessory implement, coupling the adapter frame to the accessory implement, coupling the adapter frame with the vehicle coupling plate, and coupling the front implement support frame with the adapter frame.

Preferably, the step of coupling the front implement support frame with the adapter frame comprises the steps of pushing the adapter frame against the front implement support frame, coupling hydraulic connections between the front implement and the vehicle, lifting the front implement through hydraulic actuation, to insert wedging engagement members of the front implement support frame coupling mechanism into the front implement coupling receptacle mechanism, and fastening the front implement support frame to the adapter frame to secure the two interfaces together.

Fastening the front implement support frame to the adapter frame to secure the two interfaces together can be accomplished through securing bolts or any other type of fastener or mechanism.

In the specific example of the snowplow blade and the sidewing, in order to unmount the snowplow blade and the sidewing from the vehicle, the blade support frame must be decoupled from the adapter frame and the adapter frame must then be decoupled from the vehicle coupling plate. Consequently, the plow blade and sidewing can be detached from the vehicle chassis within minutes. This allows a significant amount of weight to be removed quickly, thus enabling the vehicle chassis to be used for other tasks. Other support structures are required for operation of the sidewing on the vehicle but are known to any person versed in the art of snowplow design. As can be seen, if other types of implements are used with the vehicle, this reconfiguration capability still exists.

Preferably, the accessory implement may be permanently mounted to the adapter frame as described above.

Preferably, unmounting the front implement support frame from the adapter frame is carried out through a reverse process compared to the coupling process described and comprises the steps of releasing the fastening mechanism between the front implement support frame and the adapter frame to release the two interfaces, lowering the front implement towards the ground through hydraulic actuation, which lifts the wedging engagement members of front implement support frame coupling mechanism from the front implement coupling receptacle mechanism, uncoupling the hydraulic connections between the front implement and the vehicle, and backing the vehicle away from the front implement support frame.

Through this operation, a jack attached to the front implement support frame may be lowered in order to position the front implement support frame in a configuration ready to coupled to the adapter frame or the vehicle coupling plate.

Similarly, in the case when the implements are snowplow blades and sidewings, in order to unmount the snowplow blade and the sidewing from the vehicle, the blade support frame must be decoupled from the adapter frame and the adapter frame must then be decoupled from the vehicle coupling plate. Consequently, the plow blade and sidewing can be detached from the vehicle chassis within minutes. This allows a significant amount of weight to be removed quickly, thus enabling the vehicle chassis to be used for other tasks. Other support structures are required for operation of the sidewing on the vehicle but are known to any person versed in the art of snowplow design.

The adapter frame as well as the installation and removal methods described above greatly simplify the installation and removal process associated with the plow blade and the sidewing, which will decrease the amount of downtime required to reconfigure the vehicle for different applications.

Although the present invention has been explained hereinabove by way of a preferred embodiment thereof, it should be understood that the invention is not limited to this precise embodiment and that various changes and modifications may be effected therein without departing from the scope or spirit of the invention. For example, the interfaces between the adapter frame and the other elements, including the vehicle coupling plate, the blade support frame or the sidewing, can comprise several different types of coupling mechanisms different from the ones shown as a preferred embodiment. Furthermore, the sidewing may be fixed in a more permanent manner on the adapter frame as it will not be typically removed from the adapter frame.

What is claimed is:

1. An adapter frame for installation of a front implement and an accessory implement on a vehicle having a coupling plate, the adapter frame comprising:

a frame structure;

a hitch coupling mechanism attached to the frame structure for removably coupling the adapter frame to the vehicle coupling plate;

a front implement coupling receptacle mechanism attached to the frame structure and receiving a corresponding coupling mechanism arranged on a front implement support frame attached to a rear portion of the front implement, said front implement support frame coupling mechanism being adapted to be removably coupled to the vehicle coupling plate; and an accessory implement coupling mechanism attached to the frame structure for removably coupling the adapter frame to the accessory implement, wherein the hitch coupling mechanism and the front implement support frame coupling mechanism are matingly interfittable on the vehicle coupling plate, the hitch coupling mechanism comprises a pair of wedging engagement members shaped to be vertically inserted into corresponding apertures of receptacle structures on the vehicle coupling plate, and the front implement coupling receptacle mechanism comprises a pair of adapter receptacle structures with apertures that are shaped to vertically receive corresponding wedging engagement members on the front implement support structure.

2. The adapter frame according to claim 1, wherein the front implement is a plow blade.

3. The adapter frame according to claim 1, wherein the accessory implement is a sidewing.

4. The adapter frame according to claim 1, wherein the hitch coupling mechanism further comprises a locking system to engage and lock the adapter frame to a corresponding locking system receiving structure on the coupling plate.

5. The adapter frame according to claim 4, wherein the locking system is a bolt system.

6. The adapter frame according to claims 1, wherein the front implement coupling receptacle mechanism further comprises a locking system receiving structure shaped to receive a corresponding front implement locking system on the front implement support structure.

7. The adapter frame according to claim 6, wherein the front implement support structure locking system is a bolt system.

8. A method for removably installing a front implement and an accessory implement on a vehicle, the method comprising the steps of:

a) providing a coupling plate on the vehicle and an adapter frame comprising:

a frame structure;

a hitch coupling mechanism attached to the frame structure for removably coupling the adapter frame to the vehicle coupling plate;

a front implement coupling receptacle mechanism attached to the frame structure and receiving a corresponding coupling mechanism arranged on a front implement support frame attached to a rear portion of the front implement, said front implement support frame coupling mechanism being adapted to be removably coupled to the vehicle coupling plate; and an accessory implement coupling mechanism attached to the frame structure for removably coupling the adapter frame to the accessory implement, wherein the hitch coupling mechanism and the front implement support frame coupling mechanism are matingly interfittable on the vehicle coupling plate, the hitch coupling mechanism comprises a pair of wedging engagement members shaped to be vertically inserted into corresponding apertures of receptacle structures on the vehicle coupling plate, and the front implement coupling receptacle mechanism comprises a pair of adapter receptacle structures with apertures that are shaped to vertically receive corresponding wedging engagement members on the front implement support structure;

b) coupling the adapter frame to the accessory implement;

c) coupling the adapter frame with the vehicle coupling plate; and d) coupling the front implement support frame with the adapter frame.

9. The method according to claim 8, wherein step d) comprises the steps of:

i) pushing the adapter frame against the front implement support frame;

ii) coupling hydraulic connections between the front implement and the vehicle;

iii) lifting the front implement through hydraulic actuation, to insert engagement members of the front implement support frame coupling mechanism into the front implement coupling receptacle mechanism; and iv) fastening the front implement support frame to the adapter frame to secure the front implement support frame and the adapter frame together.

10. The method according to claim 9, wherein the fastening in step iv) is accomplished with securing bolts.

11. The method according to claim 8, wherein in step b) the accessory implement is permanently coupled to the adapter frame.

12. The method according to claim 8, wherein the front implement is a plow blade and the accessory implement is a sidewing.

13. An adapter frame for installation of a front implement on a vehicle having a coupling plate, the adapter frame comprising:

a frame structure;

a hitch coupling mechanism attached to the frame structure for removably coupling the adapter frame to the vehicle coupling plate;

a front implement coupling receptacle mechanism attached to the frame structure and receiving a corresponding coupling mechanism arranged on a front implement support frame attached to a rear portion of the front implement, said front implement support frame coupling mechanism being adapted to be removably coupled to the vehicle coupling plate; and an accessory implement attached to the frame structure, wherein the hitch coupling mechanism and the front implement support frame coupling mechanism are matingly interfittable on the vehicle coupling plate, the hitch coupling mechanism comprises a pair of wedging engagement members shaped to be vertically inserted into corresponding apertures of receptacle structures on the vehicle coupling plate and the front implement coupling receptacle mechanism further comprises a pair of adapter receptacle structures with apertures that are shaped to vertically receive corresponding wedging engagement members on the front implement support structure.

14. The adapter frame according to claim 13, wherein the front implement is a plow blade and the accessory implement is a sidewing.

15. The adapter frame according to claim 13, wherein the hitch coupling mechanism further comprises a locking system to engage and lock the adapter frame to a corresponding locking system receiving structure on the coupling plate.

16. The adapter frame according to claim 13, wherein the front implement coupling receptacle mechanism further comprises a locking system receiving structure shaped to receive a corresponding locking system on the front implement support structure.

* * * * *